US011304537B2

(12) United States Patent
Liu

(10) Patent No.: US 11,304,537 B2
(45) Date of Patent: Apr. 19, 2022

(54) ONE-BUTTON FOLDABLE BED FRAME AND PLAYARD

(71) Applicant: Anhui Coolbaby Science & Technology Develpment Corporation, Anhui (CN)

(72) Inventor: Hongbing Liu, Lu'an (CN)

(73) Assignee: Anhui Coolbaby Science & Technology Development Corporation., Anhui (CN)

( * ) Notice: Subject to any disclaimer, the term of this patent is extended or adjusted under 35 U.S.C. 154(b) by 331 days.

(21) Appl. No.: 16/484,138

(22) PCT Filed: Apr. 18, 2019

(86) PCT No.: PCT/CN2019/083275
§ 371 (c)(1),
(2) Date: Aug. 7, 2019

(87) PCT Pub. No.: WO2020/093659
PCT Pub. Date: May 14, 2020

(65) Prior Publication Data

US 2021/0330091 A1 Oct. 28, 2021

(30) Foreign Application Priority Data

Nov. 8, 2018 (CN) ..... 201811327564.0

(51) Int. Cl.
*A47D 7/00* (2006.01)
*A47D 13/06* (2006.01)

(52) U.S. Cl.
CPC ..... *A47D 7/002* (2013.01); *A47D 13/061* (2013.01)

(58) Field of Classification Search
CPC ..... A47D 7/00; A47D 7/002; A47D 13/00; A47D 13/06; A47D 13/061; A47D 13/063
See application file for complete search history.

(56) References Cited

U.S. PATENT DOCUMENTS

2007/0017025 A1 1/2007 Myer
2008/0034497 A1 2/2008 Cheng
2016/0338506 A1* 11/2016 Yang ..... A47D 13/063

FOREIGN PATENT DOCUMENTS

CN 202445581 U 9/2012
CN 203735845 U 7/2014
(Continued)

*Primary Examiner* — Fredrick C Conley
(74) *Attorney, Agent, or Firm* — JMB Davis Ben-David

(57) ABSTRACT

Disclosed arc a one-button foldable bed frame and a playard, which relate to the field of infant playard apparatus. The one-button foldable bed frame includes a base, a plurality of brackets and a plurality of folding mechanisms. One end of the bottom frame rod is hinged to the base, the other end of the bottom frame rod is hinged to the upright rod, the plurality of upright rods are provided to surround the base at intervals, the upright rod is hinged to the two frame-around rods, respectively, each of the frame-around rods is hinged to one frame-around rod of an adjacent bracket, the sliding member is slidably connected to the upright rod, the sliding member is hinged to the two frame-around connecting rods, respectively, the frame-around connecting rod is hinged to the frame-around rod, and the bottom frame rod is connected to the sliding member through the connecting rod assembly.

18 Claims, 5 Drawing Sheets

(56) References Cited

FOREIGN PATENT DOCUMENTS

| | | | |
|---|---|---|---|
| CN | 203749030 | U | 8/2014 |
| CN | 204105488 | U | 1/2015 |
| CN | 104720432 | A | 6/2015 |
| CN | 104799610 | A | 7/2015 |
| CN | 108477911 | A | 9/2018 |
| CN | 109171319 | A | 1/2019 |

* cited by examiner

ONE-BUTTON FOLDABLE BED FRAME AND PLAYARD

CROSS-REFERENCE TO RELATED APPLICATIONS

This is the U.S. National Stage of International Patent Application No PCT/CN2019/083275 filed on Apr. 18, 2019, and which claims the priority of Chinese patent application No. 2018113275640, filed with the Chinese Patent Office on Nov. 8, 2018 and entitled "One-button Foldable Bed Frame and Playard", which is incorporated herein by reference in its entirety.

TECHNICAL FIELD

The present disclosure relates to the field of infant playard apparatus, and particularly to a one-button foldable bed frame and a playard.

BACKGROUND ART

With the increasing improvement of people's living standards, the daily necessities for infants also have more and more functions. The biggest difference between a playard and an ordinary crib lies in functions, in addition to hushing the baby to sleep, a playard also allows the baby to play on the game layer, and some playards also have music and vibration functions, which can put the baby to sleep.

The base portion of the existing playard comprises a locking device, and the four sides of the upper bumper are provided with locking, respectively. At the time of folding the bed frame, the locking of the base is unlocked first, the base is folded in half to release the pre-tightening force of the bed frame, then the locking of the four sides of the bumper is unlocked separately, and then the bed frame can be folded; and at the time of unfolding the bed frame, the four sides of the upper bumper are unfolded first until they are locked, and then the base is pressed to be locked. Therefore, the operation process is complicated, it is difficult for the user to perform the operations, or the user even cannot manage it, resulting in poor user experience.

In view of this, it is especially important, particularly in daily life, to design and manufacture a one-button foldable bed frame and a playard that are convenient to operate.

SUMMARY

An object of the present disclosure comprises, providing a one-button foldable bed frame, which is simple in structure and convenient in operation, can be quickly unfolded for use or folded for storage, and has high folding efficiency, high practicability and high cost performance.

An object of the present disclosure further comprises, providing a playard, which is simple in structure and convenient in operation, can be quickly unfolded for use or folded for storage, and has high folding efficiency, high practicability, high cost performance, and good user experience.

The present disclosure is implemented using the following technical solution:

a one-button foldable bed frame, comprising a base, a plurality of brackets and a plurality of folding mechanisms, wherein the bracket comprises an upright rod, a bottom frame rod and two frame-around rods, one end of the bottom frame rod is hinged to the base, the other end of the bottom frame rod is hinged to the upright rod, the plurality of upright rods are provided to surround the base at intervals, the upright rod is hinged to the two frame-around rods, respectively, each of the frame-around rods is hinged to one frame-around rod of an adjacent bracket, the folding mechanism comprises a connecting rod assembly, a sliding member and two frame-around connecting rods, the sliding member is slidably connected to the upright rod, the sliding member is hinged to the two frame-around connecting rods, respectively, the frame-around connecting rod is hinged to the frame-around rod, the bottom frame rod is connected to the sliding member through the connecting rod assembly, and when the bottom frame rod rotates to a first preset position, the connecting rod assembly is capable of driving the sliding member to move towards one end of the upright rod close to the frame-around rod, so that the frame-around connecting rod pushes the frame-around rod up to a second preset position.

Further, the plurality of upright rods are provided to surround the base in parallel and at intervals.

Further, the connecting rod assembly comprises a first connecting rod, a second connecting rod and a third connecting rod, the first connecting rod is mounted on the upright rod and is rotatably connected to the upright rod, one end of the first connecting rod is hinged to the second connecting rod, the other end of the first connecting rod is hinged to the third connecting rod, the second connecting rod is hinged to the bottom frame rod, and the third connecting rod is hinged to the sliding member.

Further, the upright rod comprises a rod body and a foot stand, the foot stand is fixedly mounted to the bottom of the rod body and is hinged to the first connecting rod and the bottom frame rod, respectively.

Further, the bracket further comprises a balancing rod, the balancing rod is disposed in parallel with the bottom frame rod and is spaced apart from the bottom frame rod, one end of the balancing rod is hinged to the base, and the other end of the balancing rod is hinged to the foot stand.

Further, the rotation direction of the first connecting rod and the rotation direction of the bottom frame rod lie in a single plane.

Further, the sliding member comprises a mounting portion, a first connecting portion, a second connecting portion and a third connecting portion, each of the first connecting portion, the second connecting portion and the third connecting portion is fixedly connected to the mounting portion, the mounting portion is slidably connected to the upright rod, the first connecting portion is disposed opposite to the second connecting portion, the first connecting portion is hinged to one of the frame-around connecting rods, the second connecting portion is hinged to the other of the frame-around connecting rods, and the third connecting portion is hinged to the connecting rod assembly.

Further, the mounting portion is provided with a sliding groove, the upright rod is provided with a slide rail in the length direction thereof, and the sliding groove and the slide rail are slidably cooperated with each other.

Further, the frame-around rod is provided with a limit block, and the limit block selectively abuts against the other frame-around rod, so as to limit the limit position of the rotation of the frame-around rod.

Further, the one-button foldable bed frame further comprises a locking member, the locking member is mounted on the upright rod and selectively connected to the sliding member to fix the relative position of the sliding member and the upright rod.

A playard, comprising the above-described one-button foldable bed frame, wherein the one-button foldable bed frame comprises a base, a plurality of brackets and a plurality of folding mechanisms, the bracket comprises a upright rod, a bottom frame rod and two frame-around rods, one end of the bottom frame rod is hinged to the base, the other end of the bottom frame rod is hinged to the upright rod, the plurality of upright rods are provided to surround the base at intervals, the upright rod is hinged to the two frame-around rods, respectively, each of the frame-around rods is hinged to one frame-around rod of an adjacent bracket, the folding mechanism comprises a connecting rod assembly, a sliding member and two frame-around connecting rods, the sliding member is slidably connected to the upright rod, the sliding member is hinged to the two frame-around connecting rods, respectively, the frame-around connecting rod is hinged to the frame-around rod, the bottom frame rod is connected to the sliding member through the connecting rod assembly, and when the bottom frame rod rotates to a first preset position, the connecting rod assembly is capable of driving the sliding member to move towards one end of the upright rod close to the frame-around rod, so that the frame-around connecting rod pushes the frame-around rod up to a second preset position.

The one-button foldable bed frame and the playard provided by the present disclosure have the following advantageous effects:

In the one-button foldable bed frame provided by the present disclosure, one end of the bottom frame rod is hinged to the base, the other end of the bottom frame rod is hinged to the upright rod, the plurality of upright rods are provided to surround the base at intervals, the upright rod is hinged to the two frame-around rods, respectively, each of the frame-around rods is hinged to one frame-around rod of an adjacent bracket, the sliding member is slidably connected to the upright rod, the sliding member is hinged to the two frame-around connecting rods, respectively, the frame-around connecting rod is hinged to the frame-around rod, the bottom frame rod is connected to the sliding member through the connecting rod assembly, and when the bottom frame rod rotates to a first preset position, the connecting rod assembly is capable of driving the sliding member to move towards one end of the upright rod close to the frame-around rod, so that the frame-around connecting rod pushes the frame-around rod up to a second preset position. Compared with the prior art, the one-button foldable bed frame provided by the present disclosure can be quickly unfolded for use or folded for storage due to the use of the connecting rod assembly connected to the bottom frame rod and the sliding member slidably connected to the upright rod, which is convenient to operate, and has high folding efficiency, high practicability and high cost performance.

The playard provided by the present disclosure comprises the one-button foldable bed frame, which is simple in structure, can be quickly unfolded for use or folded for storage, is convenient to operate, and has high folding efficiency, high practicability, high cost performance, and good user experience.

BRIEF DESCRIPTION OF DRAWINGS

In order to more clearly illustrate the technical solutions of the embodiments of the present disclosure, brief description is made below on the drawings required to be used in the embodiments. It should be understood that the following drawings only illustrate some of the embodiments of the present disclosure and shall not be regarded as a limitation to the scope, and for a person of ordinary skills in the art, other related drawings may be obtained from these drawings without inventive effort.

REFERENCE SIGNS

Figure 1:
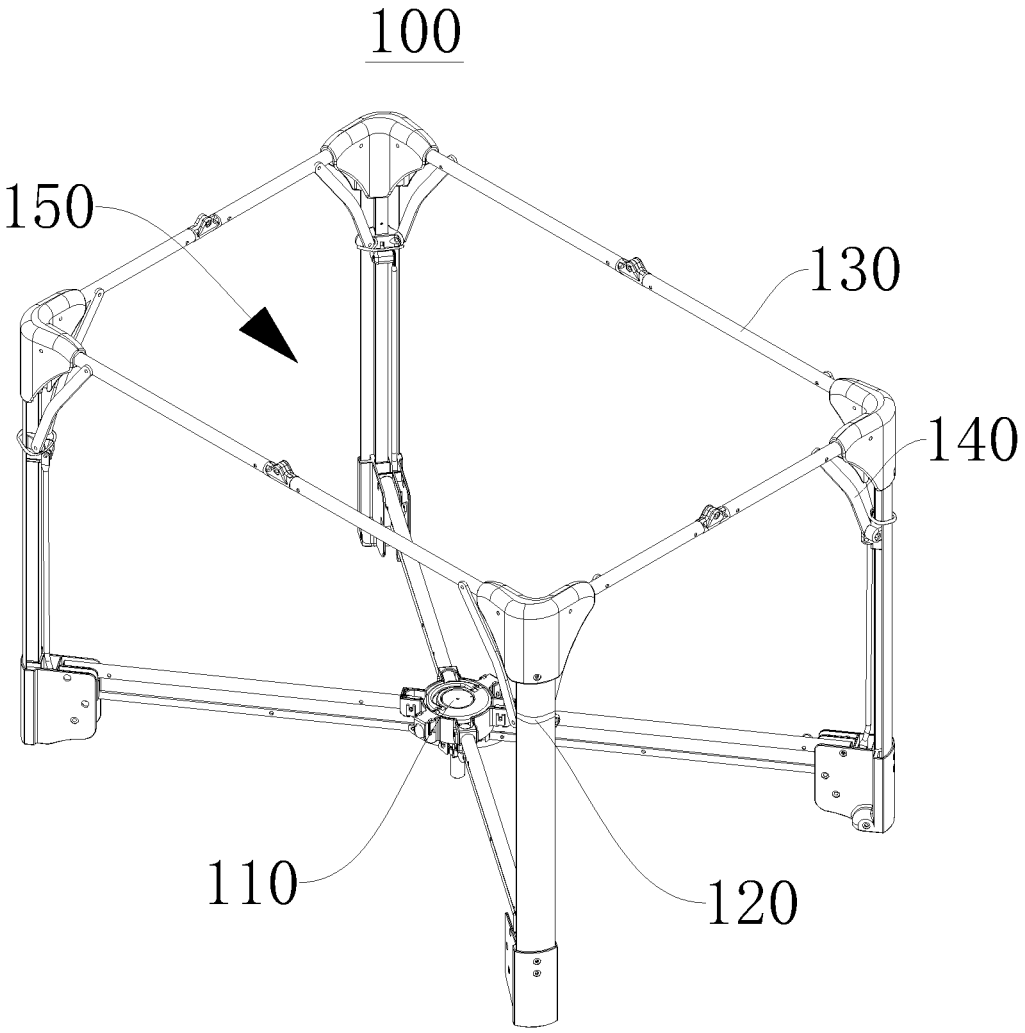
FIG. 1 is a schematic structural diagram of a one-button foldable bed frame provided by an embodiment of the present disclosure, when unfolded, viewed at an angle of view.

100—one-button foldable bed frame; 110—base; 120—locking member; 130—bracket; 131—upright rod; 132—bottom frame rod; 133—balancing rod; 134—frame-around rod; 135—rod body; 136—foot stand; 137—slide rail; 138—limit block; 140—folding mechanism; 141—connecting rod assembly; 142—sliding member; 1421—mounting portion; 1422—first connecting portion; 1423—second connecting portion; 1424—third connecting portion; 1425—sliding groove; 143—frame-around connecting rod; 144—first connecting rod; 145—second connecting rod; 146—third connecting rod; and 150—rectangular cavity.

DETAILED DESCRIPTION OF EMBODIMENTS

In order to make the objects, technical solutions and advantages of the embodiments of the present disclosure clearer, the technical solutions of the embodiments of the present disclosure will be described clearly and completely below with reference to the drawings of the embodiments of the present disclosure. Apparently, the embodiments described are some of the embodiments of the present disclosure, rather than all of the embodiments. The assembly of the embodiments of the present disclosure described and illustrated in the drawings herein can generally be arranged and designed in a variety of different configurations.

Thus, the following detailed description of the embodiments of the present disclosure provided in the drawings is not intended to limit the scope of the present disclosure claimed, but is merely representative of the selected embodiments of the present disclosure. All the other embodiments that are obtained by a person of ordinary skills in the art without inventive effort on the basis of the embodiments of the present disclosure shall be covered by the scope of protection of the present disclosure.

It should be noted that like reference signs and letters denote like items in the following drawings, and therefore, once a certain item is defined in one drawing, it does not need to be further defined or explained in the following drawings.

In the description of the present disclosure, it should be understood that the orientation or position relation denoted by the terms such as “inner”, “outer”, “upper”, “lower” and "horizontal" is based on the orientation or position relation indicated by the drawings, or refers to the orientation or position relation where the product of the present disclosure is normally placed when in use, which only serves to facilitate describing the present disclosure and simplify the description, rather than indicating or suggesting that the device or element referred to must be in a particular orientation, or is constructed and operated in a particular orientation, and therefore cannot be construed as a limitation on the present disclosure. In addition, the terms such as "first", "second" and "third" are only used for differentiated description and cannot be understood as an indication or implication of relative importance.

In the description of the present disclosure, it should be further noted that unless otherwise explicitly specified and defined, the terms "provide", "link", "install" and "connect" shall be understood in broad sense, which may, for example, refer to fixed connection, detachable connection or integral connection; may refer to mechanical connection or electrical connection; may refer to direct linking or indirect linking by means of an intermediate medium; and may refer to internal communication between two elements. A person of ordinary skills in the art could understand the specific meaning of the above terms in the present disclosure according to specific situations.

Some of the embodiments of the present disclosure are described in detail below with reference to the drawings. The features of the following embodiments can be combined with each other if there is no conflict.

Embodiments

Referring to FIG. 1, an embodiment of the present disclosure provides a playard (not shown in figure) for infants to sleep and play. The playard is simple in structure and convenient in operation, can be quickly unfolded for use or folded for storage, and has high folding efficiency, high practicability, high cost performance, and good user experience. The playard comprises a one-button foldable bed frame 100 and mounted pendants (not shown in figure). The mounted pendants are hung on the one-button foldable bed frame 100 for easy cleaning and mounting. The one-button foldable bed frame 100 can be unfolded or folded under a force applied by a user, so as to facilitate use or storage of the playard.

The one-button foldable bed frame 100 comprises a base 110, a locking member 120, a plurality of brackets 130 and a plurality of folding mechanisms 140. The plurality of brackets 130 are spaced apart from one another and are provided to surround the base 110. The plurality of brackets 130 are each hinged to the base 110, and the brackets 130 can rotate relative to the base 110. Each folding mechanism 140 is mounted on one bracket 130. The folding mechanism 140 can cause the bracket 130 to be unfolded or folded under the action of the base 110, which is convenient and practical. In this embodiment, the number of brackets 130 and the number of folding mechanisms 140 are both four, and the four brackets 130 are arranged in a rectangular array, so that a rectangular cavity 150 is formed after the one-button foldable bed frame 100 is unfolded. The locking member 120 is mounted on the bracket 130 and selectively connected to the folding mechanism 140. The locking member 120 can lock the folding mechanism 140 when the one-button foldable bed frame 100 is unfolded, thereby locking the shape of the bracket 130 to prevent the bracket 130 from being folded or deflected by an external force.

Figure 2:
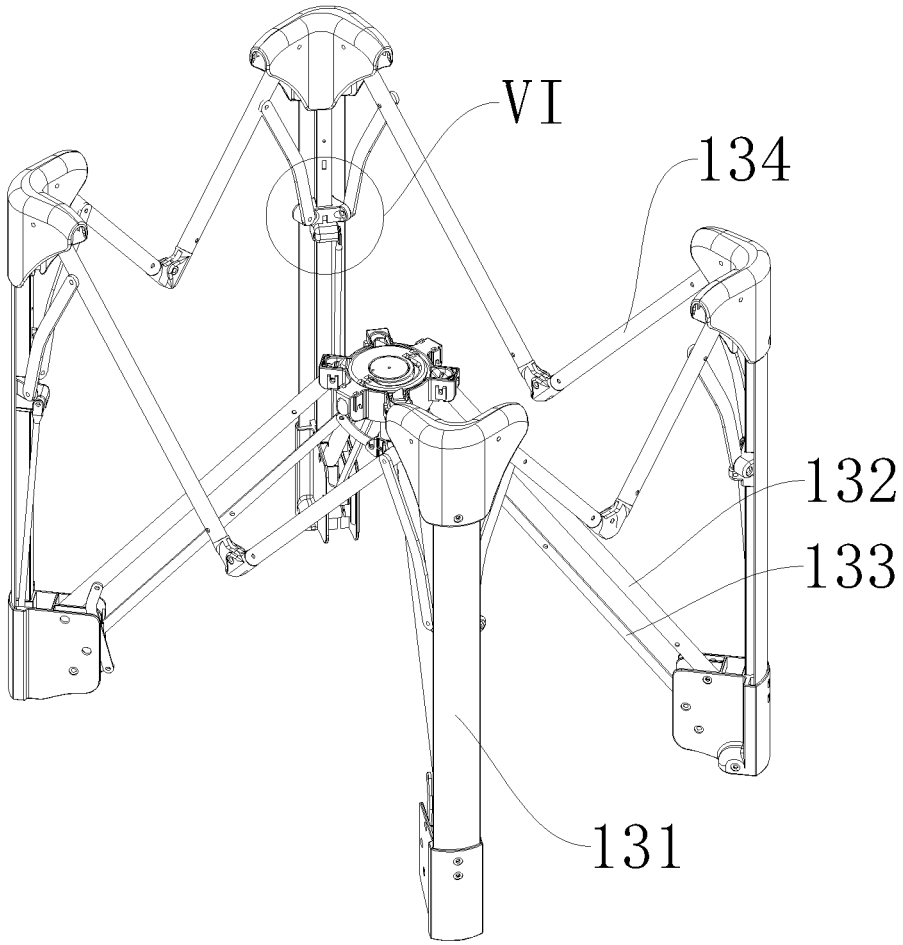
FIG. 2 is a schematic structural diagram illustrating the unfolding process of the one-button foldable bed frame provided by an embodiment of the present disclosure.
Figure 3:
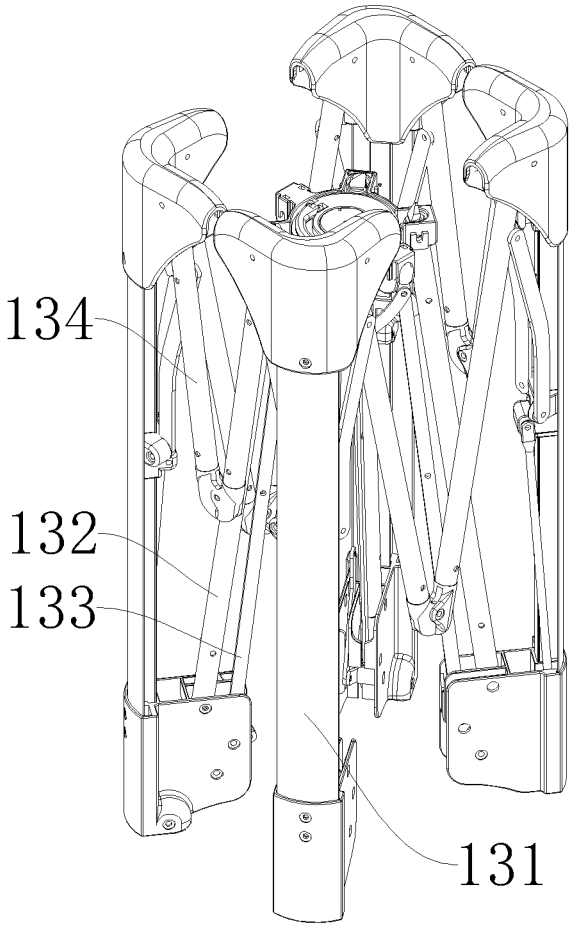
FIG. 3 is a schematic structural diagram of the one-button foldable bed frame provided by an embodiment of the present disclosure, when folded.

Referring to FIGS. 2 and 3 together, it is worth noting that the bracket 130 comprises an upright rod 131, a bottom frame rod 132, a balancing rod 133 and two frame-around rods 134. One end of the bottom frame rod 132 is hinged to the base 110, and the other end thereof is hinged to the upright rod 131. The bottom frame rod 132 is rotatable relative to the upright rod 131, so as to cause the upright rod 131 to move close to or away from the base 110. Specifically, when the one-button foldable bed frame 100 is unfolded, the angle between the bottom frame rod 132 and the upright rod 131 is 90 degree. The plurality of upright rods 131 are provided to surround the base 110 at intervals. In this embodiment, the number of upright rods 131 is four, and the four upright rods 131 are arranged in a rectangular array. The upright rods 131 are hinged to two frame-around rods 134, respectively, and both of the two frame-around rods 134 are rotatable relative to the upright rod 131, so as to bring the upright rod 131 close to or away from the base 110. Specifically, when the one-button foldable bed frame 100 is unfolded, the angle between the two frame-around rods 134 is 90 degree, and the angle between the plane where the upright rod 131 lies and the plane where the two frame-around rods 134 lie is 90 degree, thereby forming one corner angle of the rectangular cavity 150. Each frame-around rod 134 is hinged to one frame-around rod 134 of an adjacent bracket 130 to facilitate the unfolding and folding of the bracket 130. Specifically, when the one-button foldable bed frame 100 is unfolded, one frame-around rod 134 of one bracket 130 is located on the same straight line as a corresponding frame-around rod 134 of an adjacent bracket 130, so as to form one side of the rectangular cavity 150. The balancing rod 133 is disposed to be parallel to and spaced apart from the bottom frame rod 132, one end of the balancing rod 133 is hinged to the base 110, and the other end of the balancing rod 133 is hinged to the upright rod 131. When the bottom frame rod 132 rotates, the balancing rod 133 rotates synchronously, and the balancing rod 133 can increase the reliability of the hinging action of the bottom frame rod 132.

Figure 4:
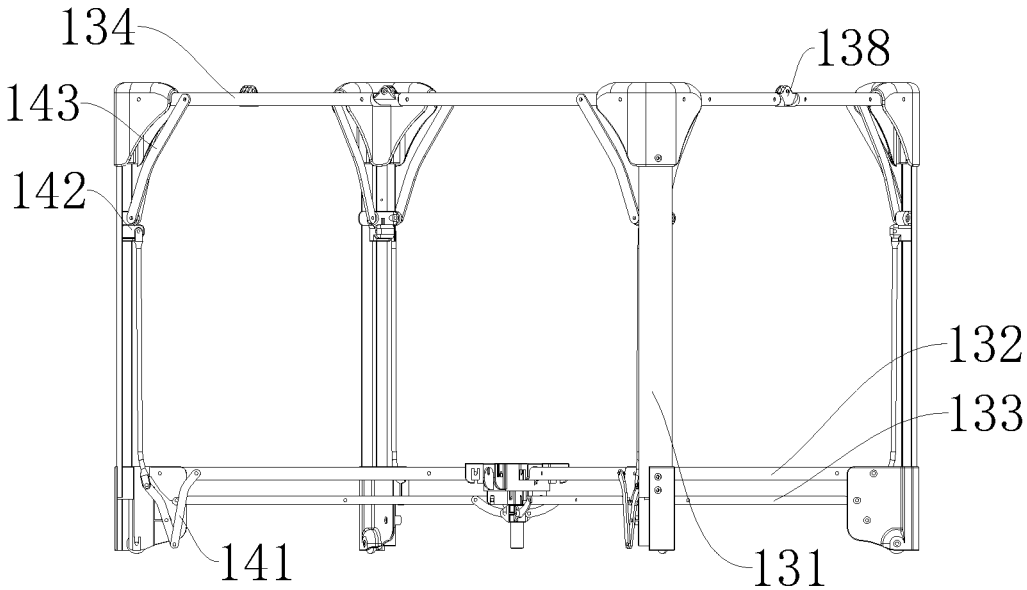
FIG. 4 is a schematic structural diagram of the one-button foldable bed frame provided by an embodiment of the present disclosure, when unfolded, viewed at another angle of view.
Figure 5:
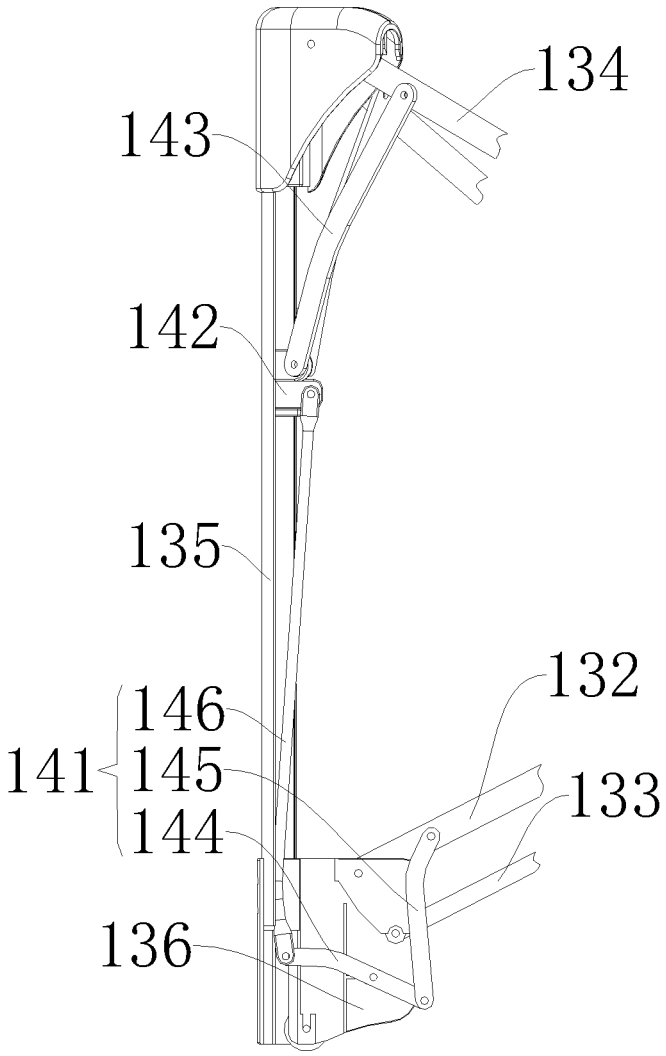
FIG. 5 is a schematic structural diagram of a folding mechanism of the one-button foldable bed frame provided by an embodiment of the present disclosure.

Referring to FIGS. 4 and 5 together, the folding mechanism 140 comprises a connecting rod assembly 141, a sliding member 142 and two frame-around connecting rods 143. The sliding member 142 is slidably connected to the upright rod 131, and the sliding member 142 can slide up and down relative to the upright rod 131. The sliding member 142 is hinged to the two frame-around connecting rods 143, respectively, and the frame-around connecting rods 143 are hinged to the frame-around rods 134. When sliding upwards relative to the upright rod 131, the sliding member 142 pushes, through the frame-around connecting rods 143, the frame-around rods 134 to rotate relative to the upright rod 131, until the frame-around rods 134 are perpendicular to the upright rod 131, and at this time, the one-button foldable bed frame 100 is completely unfolded; and when sliding downwards relative to the upright rod 131, the sliding member 142 pulls, through the frame-around connecting rods 143, the frame-around rods 134 to rotate back relative to the upright rod 131, until the frame-around rods 134 abut against the upright rod 131, and at this time, the one-button foldable bed frame 100 is completely folded. The bottom frame rod 132 is connected to the sliding member 142 through the connecting rod assembly 141, and the bottom frame rod 132 can drive, through the connecting rod assembly 141, the sliding member 142 to slide up and down relative to the upright rod 131. The connecting rod assembly 141 is capable of driving, when the bottom frame rod 132 rotates to the first preset position, the sliding member 142 to move towards the one end of the upright rod 131 close to the frame-around rod 134, so as to cause the frame-around connecting rod 143 to push the frame-around rod 134 up to the second preset position, thereby completing the unfolding action of the one-button foldable bed frame 100. In this embodiment, the first preset position is a position where the bottom frame rod 132 is perpendicular to the upright rod 131, and the second preset position is a position where the frame-around rod 134 is perpendicular to the upright rod 131. However, the first preset position and the second preset position are not limited thereto. In other embodiments, the first preset position may also be a position where the bottom frame rod 132 has a certain angle with the upright rod 131, and the second preset position may also be a position where the frame-around rod 134 has a certain angle with the upright rod 131.

It is worth noting that the connecting rod assembly 141 comprises a first connecting rod 144, a second connecting rod 145 and a third connecting rod 146. The first connecting rod 144 is mounted on the upright rod 131 and rotatably connected to the upright rod 131. Specifically, the middle portion of the first connecting rod 144 is hinged to the upright rod 131, and the first connecting rod 144 is rotatable relative to the upright rod 131. One end of the first connecting rod 144 is hinged to the second connecting rod 145, and the other end thereof is hinged to the third connecting rod 146. When the second connecting rod 145 moves downwards, the third connecting rod 146 moves upwards, and when the second connecting rod 145 moves upwards, the third connecting rod 146 moves downwards. The second connecting rod 145 is hinged to the bottom frame rod 132, and the third connecting rod 146 is hinged to the sliding member 142. When the one-button foldable bed frame 100 is unfolded, the base 110 moves downwards and drives the bottom frame rod 132 to rotate downwards relative to the upright rod 131 until the bottom frame rod 132 becomes perpendicular to the upright rod 131, at this time, the second connecting rod 145 moves downwards, the third connecting rod 146 moves upwards and pushes the sliding member 142 to slide upwards relative to the upright rod 131; and when the one-button foldable bed frame 100 is folded, the base 110 moves upwards, and drives the bottom frame rod 132 to rotate upwards relative to the upright rod 131 until the bottom frame rod 132 abuts against the upright rod 131, at this time, the second connecting rod 145 moves upwards, and the third connecting rod 146 moves downwards, and pulls the sliding member 142 to slide downwards relative to the upright rod 131.

In this embodiment, the upright rod 131 comprises a rod body 135 and a foot stand 136. The foot stand 136 is fixedly mounted at the bottom of the rod body 135, and is hinged to the first connecting rod 144 and the bottom frame rod 132, respectively, and both the first connecting rod 144 and the bottom frame rod 132 can rotate relative to the foot stand 136. The balancing rod 133 is disposed to be parallel to and spaced apart from the bottom frame rod 132, and is disposed at the bottom of the bottom frame rod 132. One end of the balancing rod 133 is hinged to the base 110, and the other end thereof is hinged to the foot stand 136. Specifically, the rotation direction of the first connecting rod 144 and the rotation direction of the bottom frame rod 132 lie in a single plane, so as to reduce the transmission resistance and improve the transmission efficiency.

In this embodiment, the frame-around rod 134 is provided with a limit block 138, and the limit block 138 selectively abuts against another frame-around rod 134 to limit the limit position of the rotation of the frame-around rod 134, so as to prevent the frame-around rod 134 from continuing rotating after rotating upwards to a position perpendicular to the upright rod 131.

Figure 6:
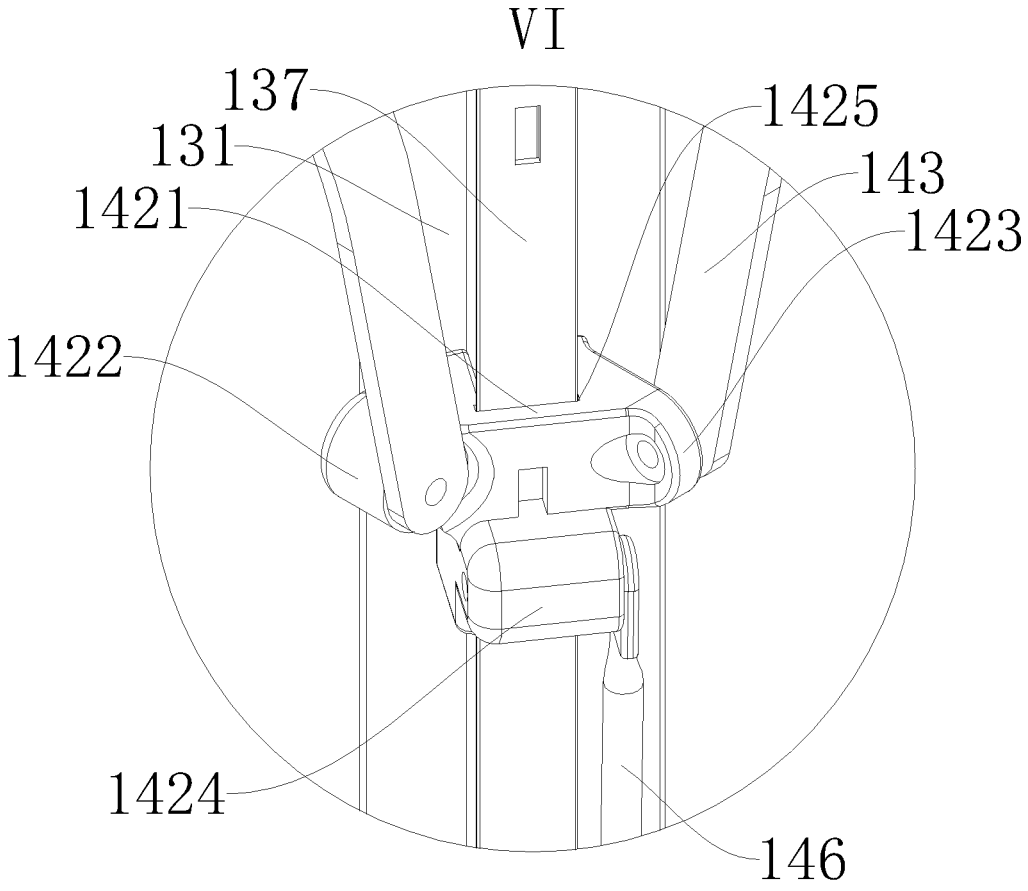
FIG. 6 is a partially enlarged view of VI in FIG. 2.

Referring to FIG. 6, the sliding member 142 comprises a mounting portion 1421, a first connecting portion 1422, a second connecting portion 1423 and a third connecting portion 1424. The first connecting portion 1422, the second connecting portion 1423 and the third connecting portion 1424 are all fixedly connected to the mounting portion 1421. In this embodiment, the first connecting portion 1422, the second connecting portion 1423, the third connecting portion 1424 and the mounting portion 1421 are formed in one piece to improve connection strength. The mounting portion 1421 is slidably connected to the upright rod 131, the first connecting portion 1422 and the second connecting portion 1423 are disposed opposite to each other, the first connecting portion 1422 is hinged to one frame-around connecting rod 143, the second connecting portion 1423 is hinged to the other frame-around connecting rod 143, the third connecting portion 1424 is disposed at the bottom of the first connecting portion 1422 and the second connecting portion 1423, and the third connecting portion 1424 is hinged to the connecting rod assembly 141. Specifically, the third connecting portion 1424 is hinged to the third connecting rod 146, and when the third connecting rod 146 drives the third connecting portion 1424 to move, the first connecting portion 1422 and the second connecting portion 1423 are synchronously driven to be displaced, thereby causing the frame-around connecting rod 143 to push upwards or pull downwards the frame-around rod 134.

It should be noted that the mounting portion 1421 is provided with a sliding groove 1425, the upright rod 131 is provided with a slide rail 137 in the length direction thereof, and the sliding groove 1425 is slidably matched with the slide rail 137, so as to reduce the sliding resistance. In this embodiment, the slide rail 137 has a T-shaped cross section, and the mounting portion 1421 is matched with the slide rail 137 to prevent the mounting portion 1421 from escaping from the slide rail 137 during the moving process.

It should be noted that the locking member 120 is mounted on the upright rod 131, and is selectively connected to the sliding member 142 to fix the relative position of the sliding member 142 and the upright rod 131, so as to fix the position of the entire folding mechanism 140, thereby fixing the shape of the one-button foldable bed frame 100. In this embodiment, the locking member 120 is a lock sleeve, and the locking member 120 is sleeved on the sliding member 142 and the upright rod 131, and when the one-button foldable bed frame 100 is unfolded, the locking member 120 is tightened, in order to bind the sliding member 142 to the upright rod 131 to prevent the sliding member 142 from moving relative to the upright rod 131.

In the process of unfolding the one-button foldable bed frame 100, first, the upright rod 131 is pulled outwards, or the base 110 is pushed downwards, at this time, the bottom frame rod 132 rotates relative to the upright rod 131, until the bottom frame rod 132 reaches a position perpendicular to the upright rod 131, in this process, the second connecting rod 145 is moved downwards under the driving of the bottom frame rod 132, and lifts the third connecting rod 146 through the first connecting rod 144, causing the third connecting rod 146 to push the sliding member 142 to move upwards, thereby pushing the frame-around connecting rod 143 to move upwards, so that the frame-around rod 134 rotates relative to the upright rod 131, until the frame-around rod 134 reaches a position perpendicular to the upright rod 131, at this time, the frame-around rod 134 is in the limit position, and then the positions of the upright rod 131 and the sliding member 142 relative to each other are fixed by the locking member 120, to prevent displacement of the sliding member 142, thereby locking the shape of the one-button foldable bed frame 100.

In the one-button foldable bed frame 100 provided by the embodiment of the present disclosure, one end of the bottom frame rod 132 is hinged to the base 110, the other end of the bottom frame rod 132 is hinged to the upright rod 131, the plurality of upright rods 131 are provided to surround the base 110 at intervals, the upright rod 131 is hinged to the two frame-around rods 134, respectively, each of the frame-around rods 134 is hinged to one frame-around rod 134 of an adjacent bracket 130, the sliding member 142 is slidably connected to the upright rod 131, the sliding member 142 is hinged to the two frame-around connecting rods 143, respectively, the frame-around connecting rod 143 is hinged to the frame-around rod 134, the bottom frame rod 132 is connected to the sliding member 142 through the connecting rod assembly 141, and when the bottom frame rod 132 rotates to the first preset position, the connecting rod assembly 141 is capable of driving the sliding member 142 to move towards one end of the upright rod 131 close to the frame-around rod 134, so that the frame-around connecting rod 143 pushes the frame-around rod 134 up to the second preset position. Compared with the prior art, the one-button foldable bed frame 100 provided by the present disclosure can be quickly unfolded for use or folded for storage due to the use of the connecting rod assembly 141 connected to the bottom frame rod 132 and the sliding member 142 slidably connected to the upright rod 131, which is convenient to operate, and has high folding efficiency, high practicability and high cost performance, and enables the playard to be convenient and practical, and have good user experience.

The descriptions above are only preferred embodiments of the present disclosure, which are not used to limit the present disclosure. For a person skilled in the art, the present disclosure may have various changes and variations. Any modifications, equivalent substitutions, improvements etc. made within the spirit and principle of the present disclosure shall all be included in the scope of protection of the present disclosure.

INDUSTRIAL APPLICABILITY

The one-button foldable bed frame provided by the present disclosure can be quickly unfolded for use or folded for storage due to the use of the connecting rod assembly connected to the bottom frame rod and the sliding member slidably connected to the upright rod, which is convenient to operate, and has high folding efficiency, high practicability and high cost performance. The playard provided by the present disclosure comprises the one-button foldable bed frame, which is simple in structure, can be quickly unfolded for use or folded for storage, is convenient to operate, and has high folding efficiency, high practicability, high cost performance, and good user experience.

The invention claimed is:

1. A one-button foldable bed frame, comprising a base, a plurality of brackets and a plurality of folding mechanisms, wherein each of the brackets comprises upright rods, a bottom frame rod and two frame-around rods, the bottom frame rod has one end hinged to the base and the other end hinged to the upright rod, the plurality of upright rods are provided to surround the base at intervals, each of the upright rods is hinged to the two frame-around rods, respectively, each of the frame-around rods is hinged to one frame-around rod of an adjacent bracket, the folding mechanism comprises a connecting rod assembly, a sliding member and two frame-around connecting rods, the sliding member is slidably connected to the upright rods, the sliding member is hinged to the two frame-around connecting rods, respectively, each of the frame-around connecting rods is hinged to one frame-around rod, the bottom frame rod is connected to the sliding member through the connecting rod assembly, wherein when the bottom frame rod rotates to a first preset position, the connecting rod assembly is capable of driving the sliding member to move towards one end of one upright rod close to the frame-around rods, so that the frame-around connecting rod pushes the frame-around rods up to a second preset position, wherein the connecting rod assembly comprises a first connecting rod, a second connecting rod and a third connecting rod, the first connecting rod is mounted on one upright rod and is rotatably connected to the one upright rod, the first connecting rod has one end hinged to the second connecting rod and the other end hinged to the third connecting rod, the second connecting rod is hinged to the bottom frame rod, and the third connecting rod is hinged to the sliding member.

2. The one-button foldable bed frame according to claim 1, wherein the plurality of upright rods are provided to surround the base in parallel and at intervals.

3. The one-button foldable bed frame according to claim 1, wherein when the one-button foldable bed frame is folded, the base moves upwards and drives the bottom frame rod to rotate upwards relative to the upright rods until the bottom frame rod abuts against the upright rods, and at this time, the second connecting rod moves upwards, and the third connecting rod moves downwards and pulls the sliding member to slide downwards relative to the upright rods.

4. The one-button foldable bed frame according to claim 1, wherein each of the upright rods comprises a rod body and a foot stand, the foot stand is fixedly mounted to a bottom of the rod body and is hinged to the first connecting rod and the bottom frame rod, respectively.

5. The one-button foldable bed frame according to claim 4, wherein each of the brackets further comprises a balancing rod, the balancing rod is disposed in parallel with the bottom frame rod and is spaced apart from the bottom frame rod, and the balancing rod has one end hinged to the base and the other end hinged to the foot stand.

6. The one-button foldable bed frame according to claim 5, wherein when the bottom frame rod rotates, the balancing rod rotates synchronously as the bottom frame rod.

7. The one-button foldable bed frame according to claim 1, wherein a rotation direction of the first connecting rod and a rotation direction of the bottom frame rod are in a single plane.

8. The one-button foldable bed frame according to claim 1, wherein the sliding member comprises a mounting portion, a first connecting portion, a second connecting portion and a third connecting portion, each of the first connecting portion, the second connecting portion and the third connecting portion is fixedly connected to the mounting portion, the mounting portion is slidably connected to one upright rod, the first connecting portion is disposed opposite to the second connecting portion, the first connecting portion is hinged to one of the frame-around connecting rods, the second connecting portion is hinged to other one of the frame-around connecting rods, and the third connecting portion is hinged to the connecting rod assembly.

9. The one-button foldable bed frame according to claim 8, wherein the mounting portion is provided with a sliding groove, each of the upright rods is provided with a slide rail in a length direction thereof, and the sliding groove and the slide rail are slidably cooperated with each other.

10. The one-button foldable bed frame according to claim 9, wherein the slide rail has a T-shaped cross section, and the mounting portion is matched with the slide rail.

11. The one-button foldable bed frame according to claim 8, wherein when the third connecting rod drives the third connecting portion to move, the first connecting portion and the second connecting portion are synchronously driven to be displaced, thereby driving the frame-around connecting rod to push upwards or pull downwards the frame-around rods.

12. The one-button foldable bed frame according to claim 1, wherein one of the frame-around rods is provided with a limit block, and the limit block selectively abuts against the other frame-around rod, so as to limit a limit position of a rotation of the frame-around rod.

13. The one-button foldable bed frame according to claim 1, wherein the one-button foldable bed frame further comprises a locking member, the locking member is mounted on one upright rod and selectively connected to the sliding member to fix a relative position of the sliding member and the one upright rod.

14. The one-button foldable bed frame according to claim 1, wherein when the one-button foldable bed frame is unfolded, the base moves downwards and drives the bottom frame rod to rotate downwards relative to the upright rods until the bottom frame rod becomes perpendicular to the upright rods, and at this time, the second connecting rod moves downwards, and the third connecting rod moves upwards and pushes the sliding member to slide upwards relative to the upright rods.

15. A playard, comprising the one-button foldable bed frame according to claim 1.

16. The playard according to claim 15, wherein the plurality of upright rods are provided to surround the base in parallel and at intervals.

17. The playard according to claim 15, wherein each of the upright rods comprises a rod body and a foot stand, the foot stand is fixedly mounted to a bottom of the rod body and is hinged to the first connecting rod and the bottom frame rod, respectively.

18. The playard according to claim 17, each of the brackets further comprises a balancing rod, the balancing rod is disposed in parallel with the bottom frame rod and is spaced apart from the bottom frame rod, and the balancing rod has one end hinged to the base and the other end hinged to the foot stand.

* * * * *